US009837006B2

(12) United States Patent
Hwang et al.

(10) Patent No.: US 9,837,006 B2
(45) Date of Patent: Dec. 5, 2017

(54) LIQUID CRYSTAL DISPLAY DEVICE AND DISPLAY SYSTEM WITH THE SAME

(71) Applicant: LG DISPLAY CO., LTD., Seoul (KR)

(72) Inventors: In Sung Hwang, Gumi-si (KR); Jong Dae Kim, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 121 days.

(21) Appl. No.: 14/981,409

(22) Filed: Dec. 28, 2015

(65) Prior Publication Data

US 2016/0189581 A1 Jun. 30, 2016

(30) Foreign Application Priority Data

Dec. 31, 2014 (KR) ..... 10-2014-0195839

(51) Int. Cl.
*G09G 3/00* (2006.01)
*G09G 3/36* (2006.01)

(52) U.S. Cl.
CPC ..... *G09G 3/006* (2013.01); *G09G 3/3611* (2013.01); *G09G 2330/12* (2013.01)

(58) Field of Classification Search
CPC ... G09G 3/006; G09G 3/3611; G09G 2330/12
See application file for complete search history.

(56) References Cited

U.S. PATENT DOCUMENTS 8,321,883 B2 11/2012 Smirnov
2010/0244705 A1* 9/2010 Hajjar ..... G09G 3/006 315/129
2011/0095899 A1* 4/2011 Saito ..... B61L 15/0036 340/691.6
2013/0050176 A1* 2/2013 Kim ..... G09G 3/36 345/214

FOREIGN PATENT DOCUMENTS

KR 10-2008-0127456 12/2008
KR 10-2008-0127485 12/2008
KR 10-2008-0132466 12/2008

* cited by examiner

*Primary Examiner* — Sahlu Okebato
(74) *Attorney, Agent, or Firm* — Dentons US LLP

(57) ABSTRACT

A liquid crystal display device is disclosed which includes a diagnosis controller configured to receive abnormity detection signals representing whether components of the liquid crystal display device are functioning normal. The components of the liquid crystal display device may include an LVDS interface, a timing controller, a data driver circuit, a backlight driver, a supply voltage generator. Such a liquid crystal display device handles treatable abnormities without any external help. In accordance therewith, complexity caused by transferring a large number of signals can be simplified.

14 Claims, 5 Drawing Sheets

LIQUID CRYSTAL DISPLAY DEVICE AND DISPLAY SYSTEM WITH THE SAME

CROSS REFERENCE TO RELATED APPLICATION

This application claims the benefit of Korean Patent Application No. 10-2014-0195839, filed on Dec. 31, 2014 which is hereby incorporated by reference in its entirety for all purposes as if fully set forth herein.

BACKGROUND

Field of the Disclosure

The present application relates to a liquid crystal display device and a display system with the same.

Description of the Related Art

Display devices are devices for displaying images and information. Among the display devices, a liquid crystal display device adjusts light transmittance of liquid crystal using an electric field and displays the image.

The liquid crystal display device allows data voltages to be transferred from a data driver, which is controlled by timing control signals applied from a timing controller, to a liquid crystal display panel. In accordance therewith, images can be displayed.

A liquid crystal display device may be applied to a vehicle. For example, the liquid crystal display device is disposed in a center console between a driver's seat and a passenger seat and used in a navigator or a video reproduction.

If the liquid crystal display device is used in the navigator, the navigator cannot display some images due to its abnormal screen. In this case, a driver driving his vehicle toward a destination on the basis of indications of the navigator may be largely inconvenienced.

In view of this point, it is greatly necessary to closely diagnose components of the liquid crystal display device before an abnormity is generated in the liquid crystal display device. Nevertheless, technologies regarding such diagnosable display device and system are not being actively developed up to the present.

BRIEF SUMMARY

Accordingly, embodiments of the present application are directed to a liquid crystal display device and a display device using the same that substantially obviate one or more problems due to the limitations and disadvantages of the related art.

The embodiments provide a liquid crystal display device and a display device with the same which are adapted to precisely diagnose abnormal probabilities by performing a diagnosis for a detailed portion.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

In order to achieve the above-mentioned features and the other objects, a liquid crystal display device according to a general aspect of the present embodiment includes a diagnosis controller configured to receive abnormity detection signals representing whether or not components of the liquid crystal display device are normal. The components of the liquid crystal display device can include an LVDS interface, a timing controller, a data driver circuit, a backlight driver, a supply voltage generator and so on. Such a liquid crystal display device handles treatable abnormities without any external help. In accordance therewith, complexity caused by transferring a large number of signals can be simplified.

A display system according to another general aspect of the present embodiment includes: a plurality of liquid crystal display devices which each includes a diagnosis controller configured to receive abnormity detection signals representing whether or not components of the liquid crystal display device are normal; and a system controller configured to perform measures opposite to the diagnosed resultants which are transferred from the liquid crystal display devices. As such, the system controller is not necessary to directly diagnose the liquid crystal display devices. The liquid crystal display devices can generally diagnose their states and transfer their diagnosed resultants to the system controller. In accordance therewith, each of the liquid crystal display devices can be connected to the system controller through only one signal line. Therefore, the number of signal lines can be largely reduced, and furthermore a complex wiring structure can be simplified.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Reference will now be made in detail to the embodiments of the present disclosure, examples of which are illustrated in the accompanying drawings. Throughout this disclosure including the drawings, the same and like parts should be referred to as the same reference numbers and the overlapping description thereof can be omitted. Suffixes of component used in this disclosure can be defined or mixedly used for the convenience of explanation. In other words, the suffixes of the components have no meanings or functions distinguished from one another. In other instances, well-known technologies have not been described in detail in order to avoid obscuring the present disclosure. Also, the accompanying drawings are prepared in order to provide an understanding of the various embodiments of the present disclosure. As such, the technical spirits of the present disclosure are not limited to the accompanying drawings. In accordance therewith, it must be considered that the scope of the present disclosure includes various changes, modifications, equivalents and substitutes of the embodiments without departing from the technical spirit of the present disclosure.

Figure 1:
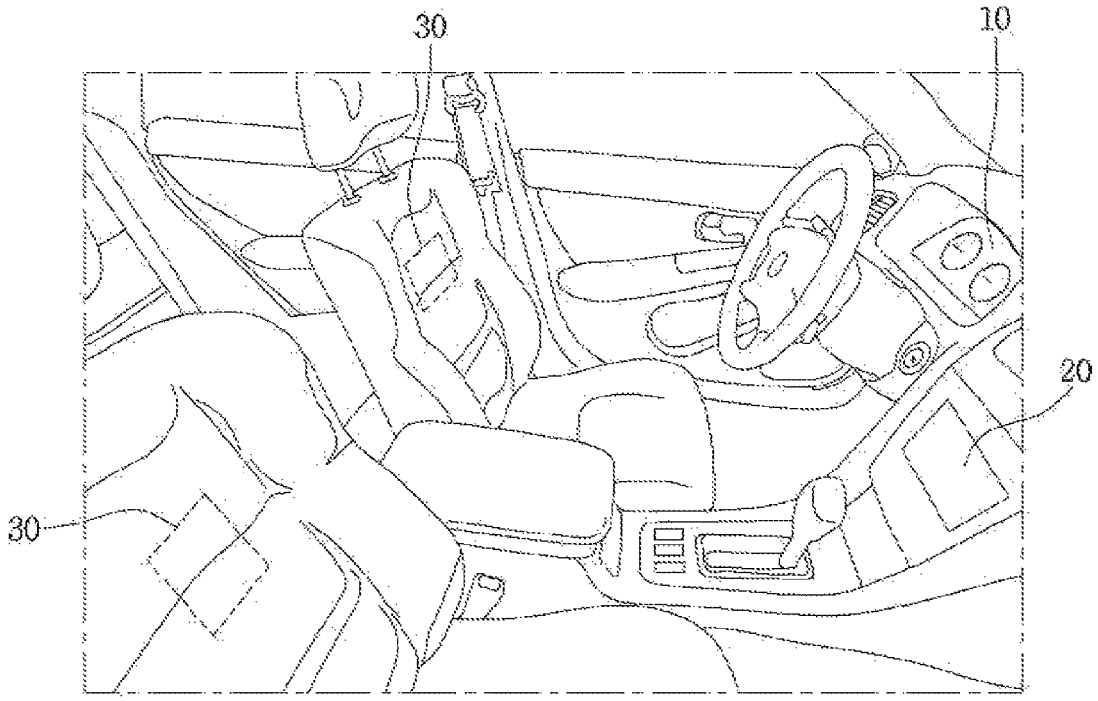
FIG. 1 is a perspective view showing the interior of a vehicle which includes a plurality of liquid crystal display devices in accordance with an embodiment of the present disclosure.

FIG. 1 is a perspective view showing the interior of a vehicle which includes a plurality of liquid crystal display devices in accordance with an embodiment of the present disclosure.

As shown in FIG. 1, a plurality of liquid crystal display devices can be disposed in the interior of a vehicle. For example, a first liquid crystal display device 10 can be disposed in front of a driver's car seat, a second liquid crystal display device 20 can be disposed in a center console, and at least one third liquid crystal display device 30 can be disposed in front of a back car seat, i.e., on a rear surface of a backrest of a driver's car seat or a booster car seat. The third liquid crystal display device 30 can be disposed on either only the rear surface of the backrest of the driver's car seat or both of the rear surfaces of the backrests of the driver's car seat and the booster car seat.

As an example, the first liquid crystal display device 10 can be a display device of a console board, the second liquid crystal display device 20 can be a display of a navigator, and the third liquid crystal display device 30 can be a display device of an entertainment appliance. As such, a variety of information including a speed meter, a fuel gauge and so on can be displayed on the first liquid crystal display device 10. The second liquid crystal display device 20 can display navigation information. The third liquid crystal display device 30 can include an audio playing function, a video playing function and a broadcast channel tuning function. Also, a variety of information such as movies, broadcast programs, singing exercise programs, games or others can be displayed on the third liquid crystal display device 30. However, the third liquid crystal display device 30 is not limited to these.

In this manner, the variety information which must be frequently checked by a driver driving a vehicle is displayed on the first liquid crystal display device 10 and the second liquid crystal display device 20. As such, any abnormal symptom must not be generated in the first and second liquid crystal display devices 10 and 20. If any information is not displayed on the first liquid crystal display device 10 due to the generation of an abnormal phenomenon in the first liquid crystal display device 10, the driver cannot obtain various real-time information including a current driving state, a current fuel quantity and so on. On the other hand, when the second liquid crystal display device 20 cannot display information due to an abnormity, the driver must determine his own way to the destination.

In accordance therewith, it is necessary that the first and second liquid crystal display devices 10 and 20 are generally diagnosed through a close check for an abnormity or not, prior to the third liquid crystal display device 30.

Figure 2:
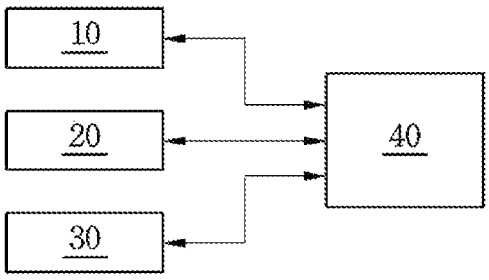
FIG. 2 is a block diagram showing a display system of the vehicle according to an embodiment of the present disclosure.

In view of this point, the present disclosure enables the first through third liquid crystal display devices 10, 20 and 30 to diagnose their states on the basis of close self-check information and transfer simplified diagnosis resultants to a main controller of the respective vehicle which corresponds to a system controller 40 of FIG. 2. Moreover, the first and second liquid crystal display devices 10 and 20 can more generally diagnose their states by performing a more close and various check, compared to the third liquid crystal display device 30. In this case, the system controller 40 of the respective vehicle can grasp current states of the first through third liquid crystal display devices 10, 20 and 30 on the basis of the diagnosis resultants, which are transferred from the first through third liquid crystal display devices 10, 20 and 30, without directly diagnosing the first through third liquid crystal display devices 10, 20 and 30. As such, each of the first through third liquid crystal display devices 10, 20 and 30 can be connected to the system controller 40 through only one signal line. In accordance therewith, the number of signal lines can be largely reduced, and furthermore a complex wiring structure can be simplified.

Also, makers of the first through third liquid crystal display devices 10, 20 and 30 should be ordinary skilled persons in the art in accordance with the present disclosure. As such, a diagnosis circuit suitable for each of the first through third liquid crystal display devices 10, 20 and 30 can be laid-out by the makers of the liquid crystal display device which correspond to the ordinary skilled persons in the art of the present disclosure. Therefore, the diagnosis performances of the first through third liquid crystal display devices 10, 20 and 30 can be more enhanced.

FIG. 2 is a block diagram showing a display system of the vehicle according to an embodiment of the present disclosure.

The first through third liquid crystal display devices 10, 20 and 30 shown in FIG. 2 can be disposed at a variety of positions within the vehicle.

Referring to FIG. 2, a display system of the vehicle can include first through third liquid crystal display devices 10, 20 and 30 and a system controller 40.

The system controller 40 can transfer desired information and signals to the first through third liquid crystal display devices 10, 20 and 30.

For example, the system controller 40 can apply a variety of information, which includes a current speed of the vehicle, a current fuel quantity and so on, to the first liquid crystal display device 10. The first liquid crystal display device 10 can display the current speed of the vehicle, the current fuel quantity and so on which are received from the system controller 40.

For example, the system controller 40 can transfer navigation information to the second liquid crystal display device 20. The second liquid crystal display device 20 can display the navigation information received from the system controller 40.

For example, the system controller 40 can transfer entertainment information, such as a movie, a broadcast program, a singing exercise program, a game or other, received from the third liquid crystal display device 30. The third liquid crystal display device 30 can display the entertainment information from the system controller 40.

On the other hand, each of the first through third liquid crystal display devices 10, 20 and 30 can self-diagnose whether or not abnormity and transfer a diagnosis resultant to the system controller 40. The system controller 40 can perform measures opposite to the diagnosis resultants which are received from the first through third liquid crystal display devices 10, 20 and 30.

For example, each of the first through third liquid crystal display devices 10, 20 and 30 can supply the system controller 40 with the diagnosis resultant corresponding to one of abnormal degrees represented in the following table 1.

TABLE 1

| | Abnormal degree | | |
|---|---|---|---|
| | Lv1 | Lv2 | Lv3 |
| Diagnosis resultant | Normal | Need of inspection | Need of exchange |

The system controller 40 can receive the diagnosis resultant with a first level Lv1, which represents a normal state, from each of the first through third liquid crystal display devices 10, 20 and 30. In this case, the system controller 40 can determine that any abnormity is generated in each of the first through third liquid crystal display devices 10, 20 and 30. As such, the system controller 40 does not perform any measure for each of the first through third liquid crystal display devices 10, 20 and 30.

Also, the diagnosis resultant with a second level Lv2 representing 'need of inspection' can be transferred from one of the first through third liquid crystal display devices 10, 20 and 30 to the system controller 40. As such, the system controller 40 can not only display a massage of "Need to inspect the respective liquid crystal display device and please visit a near service center" on at least one of the other liquid crystal display devices but also output the same massage in a voice.

Moreover, if the diagnosis resultant with a third level Lv3 representing 'need of exchange' is received from one of the first through third liquid crystal display devices 10, 20 and 30, the system controller 40 can perform a measure suitable for an urgent circumstance by controlling at least one of the other liquid crystal display devices.

For example, if any information is not displayed on the screen of the first liquid crystal display device 10, the system controller 40 can supply the second liquid crystal display device 20 with the various information, which includes the current speed, the current fuel quantity and so on and will be applied to the first liquid crystal display device 10. As such, the information for the first liquid crystal display device 10 can be displayed on the second liquid crystal display device. In this case, only the varied information including the current speed, the current fuel quantity and so on can be displayed on the second liquid crystal display device 20. Alternatively, the varied information for the first liquid crystal display device 10 together with the navigation information can be simultaneously displayed on the second liquid crystal display device 20.

As another example, when any information is not displayed on the screen of the second liquid crystal display device 20, the system controller 40 can supply the first liquid crystal display device 10 with the navigation information which will be displayed on the second liquid crystal display device 20. As such, the navigation information for the second liquid crystal display device 20 can be displayed on the first liquid crystal display device 10. In this case, only the variety of information including the current speed, the current fuel quantity and so on can be displayed on the first liquid crystal display device 10. Alternatively, the variety of information for the first liquid crystal display device 10 together with the navigation information can be simultaneously displayed on the first liquid crystal display device 10.

The first through third liquid crystal display devices 10, 20 and 30 can each have a touch panel function. As such, the first liquid crystal display device 10 can perform an operation corresponding to a command which is input by the driver using the touch panel function, even though the navigation information is temporarily displayed on the first liquid crystal display device 10. In detail, the first liquid crystal display device 10 can supply the system controller 40 with a first command input by the driver. Then, the system controller 40 can search a fixed destination corresponding to the first command and transfer the searched resultant to the first liquid crystal display device 10. In accordance therewith, the first liquid crystal display device 10 can display the searched resultant transferred from the system controller 40. Subsequently, the first liquid crystal display device 10 can transfer a second command, which is input by the driver, to the system controller 40. The system controller 40 responsive to the second command can not only guide the driver's vehicle from a current position to the fixed destination, but also transfer map information, which corresponds to a path (or route) from the current position to the fixed destination, to the first liquid crystal display device. Therefore, the first liquid crystal display device 10 can display the map information received from the system controller 40.

Moreover, when the diagnosis resultant with the third level Lv3 representing 'need of exchange' is received from one of the first through third liquid crystal display devices 10, 20 and 30 to the system controller 40, the system controller 40 can not only display a massage of "Please visit a near service center as soon as possible and exchange the respective liquid crystal display device" on at least one of the other liquid crystal display devices but also output the same massage in a voice. For example, when any information is not displayed on the screen of the first liquid crystal display device 10, the above-mentioned massage can be displayed on the second liquid crystal display device 20.

In this manner, the present disclosure can enable not only each of the first through third liquid crystal display devices 10, 20 and 30 to transfer the simplified diagnosis resultant to the system controller 40 but also the system controller 40 to execute the measure opposite to the received diagnosis resultant. Consequently, it is not necessary for the first through third liquid crystal display devices 10, 20 and 30 to transfer detailed diagnosis resultants for components of the first through third liquid crystal display devices 10, 20 and 30. As such, signals lines for transferring the detailed diagnosis information from the components to the system controller 40 can be removed. Therefore, the number of signal lines can be greatly reduced and furthermore the complex wiring structure can be simplified.

Also, makers of the first through third liquid crystal display devices 10, 20 and 30 should be ordinary skilled persons in the art in accordance with the present disclosure. As such, a diagnosis circuit suitable for each of the first through third liquid crystal display devices 10, 20 and 30 can be laid-out by the makers of the liquid crystal display device which correspond to the ordinary skilled persons in the art of the present disclosure. Therefore, the diagnosis performances of the first through third liquid crystal display devices 10, 20 and 30 can be more enhanced.

Moreover, the present disclosure can allow the first through third liquid crystal display devices 10, 20 and 30 to handle treatable abnormities themselves without any help of the system controller 40. In accordance therewith, complexity caused by transferring a large number of signals can be simplified.

Figure 3:
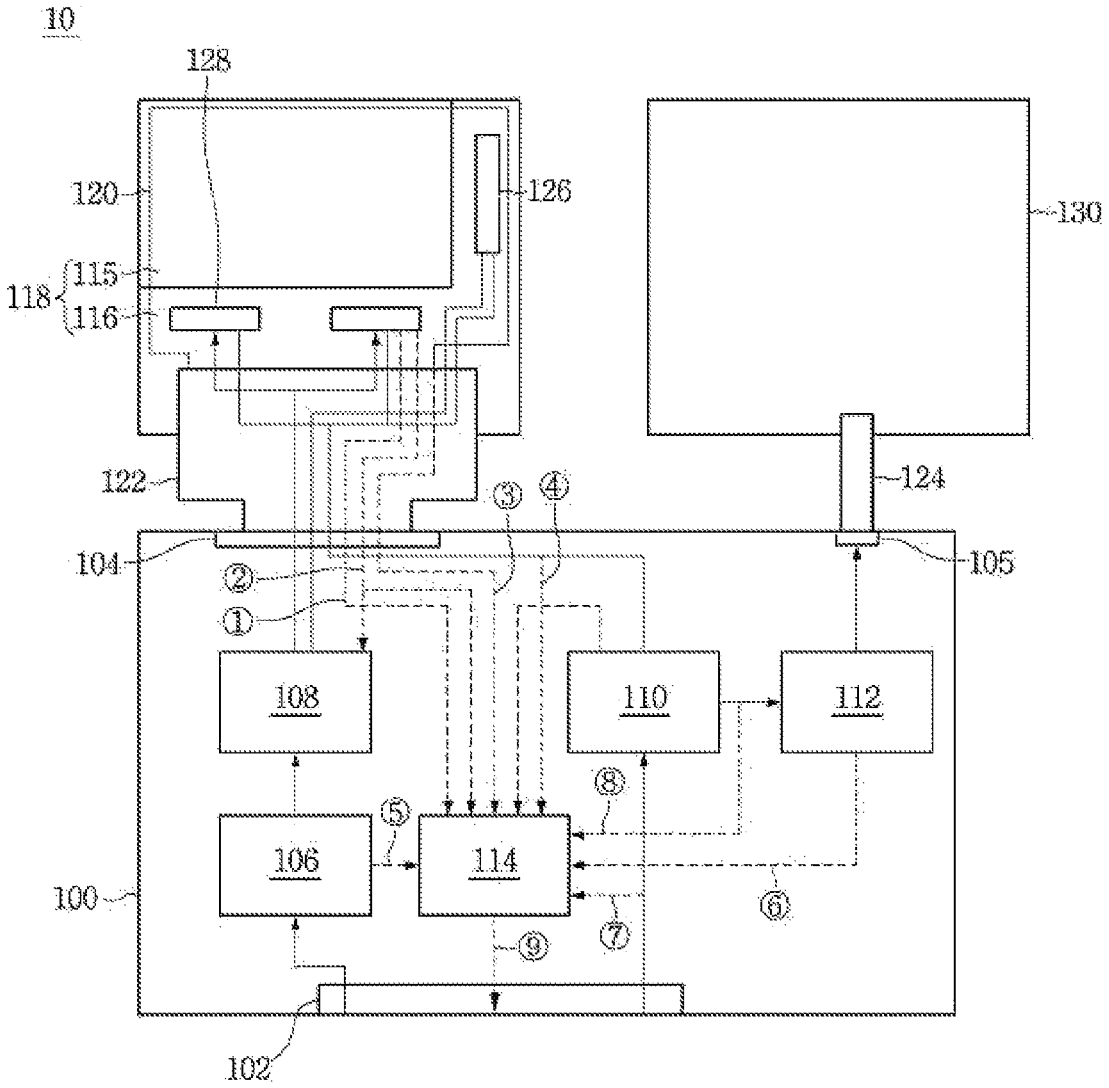
FIG. 3 is a block diagram showing one of the liquid crystal display devices shown in FIG. 1.

FIG. 3 is a block diagram showing one of the liquid crystal display devices shown in FIG. 1.

The liquid crystal display device shown in FIG. 3 can become one of the first through third liquid crystal display devices 10, 20 and 30 shown in FIGS. 1 and 2.

For the convenience of explanation, the liquid crystal display device will now be described in a manner limited to the first liquid crystal display device 10 shown in FIGS. 1 and 2. However, the second and third liquid crystal display devices 20 and 30 can also have the same components and functions as that shown in FIG. 3.

Referring to FIG. 3, the liquid crystal display device 10 can include a printed circuit board 100, a liquid crystal display panel 118 and a backlight unit 130.

The printed circuit board 100 includes an input connector 102 configured to receive external signals and output connectors 104 and 105 configured to output signals. The input connector 102 can be disposed in an edge of the printed circuit board 100, and the output connectors 104 and 105 can be disposed in another edge of the printed circuit board 100. Also, the input connector 102 and the output connectors 104 and 105 can each be fabricated in a module shape and disposed on the printed circuit board 100. However, the present disclosure is not limited to this.

Such output connectors 104 and 105 can include a first output connector 104 and a second output connector 105. The first output connector 104 can be used to output signals to the liquid crystal display panel 118. The second output connector 105 can be used to output signals to the backlight unit 130.

The first output connector 104 of the printed circuit board 100 can be connected to the liquid crystal display panel 118 through a first carrier package 122. The second output connector 105 of the printed circuit board 100 can be connected to the backlight unit 130 through a second carrier package 124.

Each of the first and second carrier packages 122 and 124 can be a flexible printed circuit, but is not limited to this.

One edge (or end) of the first carrier package 122 can be connected to the printed circuit board 100 by being tightly inserted into the first output connector 104. Another edge (or the other end) of the first carrier package 122 can be connected to the liquid crystal display panel 118 through a bonding process. A bonding resistance depends on a degree of the bonding combination between the first carrier package and the liquid crystal display panel 118. For example, if the bonding combination between the first carrier package 122 and the liquid crystal display panel 118 is not superior, the bonding resistance between the first carrier package 122 and the liquid crystal display panel 118 increases. In this case, a signal being transferred from the first carrier package 122 to the liquid crystal display panel 118 is attenuated and delayed due to the increased bonding resistance. Due to this, image quality of the liquid crystal display panel 118 can deteriorate or the liquid crystal display panel 118 can malfunction.

Similarly, one end of the second carrier package 124 can be tightly inserted into the second output connector 105 and the other end of the second carrier package 124 can be connected to the backlight unit 130 through the bonding process.

The printed circuit board 100 can be loaded with circuits and IC (integrated circuit) chips which have a variety of functions. For example, the printed circuit board 100 can include an LVDS (Low Voltage Differential Signal) interface 106, a timing controller 108, a supply voltage generator 110, a backlight driver 112, a diagnosis controller 114 and so on.

The LVDS interface 106 can be connected to the system controller 40 through the input connector 102 and designed to receive signals of the system controller 40 in a high speed without any noise. Also, the LVDS interface 106 can transfer the received signals to the timing controller 108 without any noise.

The signals transferred by the LVDS interface 106 can include a clock signal, synchronous signals, a digital video data signal and so on.

The timing controller 108 derives timing control signals, which are used to control operation timings of data driver circuits 128 and gate driver circuits 126, from the output signals of the LVDS interface 106. The timing control signals includes gate timing control signals, which are used to control the operation timings of the gate driver circuits 126 and data timing control signals which are used to control the operation timings of the data driver circuits 128.

Such a timing controller 108 can be connected to the data driver circuits 128 in a point-to-point mode. Also, the timing controller 108 can transfer a preamble signal, a data control signal, a clock signal, the digital video data signal and so on to the data driver circuits 128 through a single pair of data lines as an EPI (clock Embedded Point-to-point Interface) data signal. The preamble signal is used to initialize the data driver circuits 128.

Such a data transmission method is based on an EPI transfer protocol. The EPI transfer protocol satisfies the following three interface regulations.

(1) The timing controller 108 corresponding to a sending end is connected to the data driver circuits 128, which correspond to receiving ends, in a point-to-point mode by a single pair of lines.

(2) Any additional pair of clock lines is not connected between the timing controller 108 and the data driver circuits 128. The timing controller 108 can transfer the clock signal, the data control signal and the video data signal to the data driver circuits 128.

(3) Each of the data driver circuits 128 includes a built-in DLL (Delay Locked Loop) configured to recovery clock and data. As such, the timing controller 108 can supply the data driver circuit 128 with the preamble signal which is used to lock output phase and frequency of the DLL. The DLL built in the data driver circuit 128 can lock its output phase and then generate an internal clock in response to the preamble signal and the clock signal.

The above-mentioned EPI transfer protocol method has been disclosed in Korean Patent Application Nos. 10-2008-0127485 (Dec. 15, 2008), 10-2008-127456 (Dec. 15, 2008) and 10-2008-132466 (Dec. 23, 2008) and U.S. patent application Ser. No. 12/543,966 (Aug. 19, 2009), Ser. No. 12/461,652 (Aug. 19, 2009) and Ser. No. 12/537,341 (Aug. 7, 2009).

The supply voltage generator 110 can generate a plurality of driving voltages, a plurality of reference voltages and so on. For example, the plurality of driving voltages can be applied to the respective components such as the LVDS interface 106, the timing controller 108, the backlight driver 112 and the diagnosis controller 114. The plurality of reference voltages can be used to generate a plurality of gamma voltages as an example, but it is not limited to this.

The backlight driver 112 can generate backlight driving voltages, which is used to drive the backlight unit 130, under control of the timing controller 108. The backlight unit 130 can include a plurality of lamps or a plurality of light emitting diodes (LEDs). The backlight unit 130 can either adjust intensity of light emitted from one of the lamp and the LED, or control the lamps or the LEDs to sequentially emit, on the basis of the backlight driving voltage applied from the backlight driver 112.

The liquid crystal display panel 118 can display images. The liquid crystal display panel 118 can be connected to the printed circuit board 100 through the first carrier package 122.

Also, the liquid crystal display panel 118 can include an upper substrate 115, a lower substrate 116 and a liquid crystal layer (not shown). The liquid crystal layer is interposed between the two substrates 115 and 116.

The lower substrate 116 can be defined into a plurality of pixels P by crossing a plurality of gate lines GL and a plurality of data lines DL. Each of the pixels P can include a thin film transistor, which is connected to one of the gate lines GL and one of the data lines DL, and a pixel electrode connected to the thin film transistor. The pixel electrodes formed on the respective pixels P can be separated from one another.

Color filters, a black matrix and so on are formed on the upper substrate 115. The color filters are formed opposite to the pixels on the lower substrate 116 and separated from one another by the black matrix.

A common electrode receiving a common voltage can be formed on one of the upper substrate 115 and the lower substrate 116. For example, if the liquid crystal display panel 118 is driven a vertical field mode such as a TN (Twisted Nematic) mode or a VA (Vertical Alignment) mode, the common electrode is formed on the upper substrate 115. Alternatively, when the liquid crystal display panel 118 is driven in a horizontal field mode such as an IPS (In Plane Switching) mode or an FFS (Fringe Field Switching) mode, the common electrode together with the pixel electrodes can be formed on the lower substrate 116.

In order to display images, the liquid crystal display panel 118 can control light transmittance of the liquid crystal layer on the basis of the data voltage applied to each of the pixels P.

The gate driver IC chips 126 and the data driver IC chips 128 can be disposed on the liquid crystal display panel 118.

The gate driver circuits 126 can be built in the liquid crystal display panel 118 using a gate-in-panel (GIP) technology. In other words, the gate driver circuits 126 can be simultaneously formed on the liquid crystal display panel 118 when the thin film transistors are formed on the liquid crystal display panel 118 using a semiconductor procedure.

Each of the gate driver circuits 126 can sequentially generate gate signals using the gate timing control signals. The gate signals are applied from the gate driver circuits to the respective gate lines.

The data driver circuits 128 can be fabricated in integrated-circuit (IC) chips and directly disposed on the liquid crystal display panel 118 (in detail, on the lower substrate 116) through a bonding process. Such a bonding mode can be called a chip-on-glass (COG) mode.

A bonding resistance between the data driver circuit 128 and the liquid crystal display panel 118 depends on a degree of the bonding combination between the data driver circuit 128 and the liquid crystal display panel 118. For example, if the bonding combination between the data driver circuit 128 and the liquid crystal display panel 118 is not superior, the bonding resistance between the data driver circuit 128 and the liquid crystal display panel 118 increases. In this case, a signal being transferred from the data driver circuit 128 to the liquid crystal display panel 118 is attenuated and delayed due to the increased bonding resistance. Due to this, image quality of the liquid crystal display panel 118 can deteriorate or the liquid crystal display panel 118 can malfunction.

The data driver circuit 128 can derive a reference clock signal from the EPI data signal which is applied from the timing controller 108. Also, the data driver circuit 128 can generate a data control signal and a polarity control signal using the reference clock signal. Moreover, the data driver circuit 128 can convert the video data signal under control of the data control signal and the polarity control signal. The converted data voltages can be transferred from the data driver circuits 128 to the respective data lines on the liquid crystal display panel 108.

Such a liquid crystal display panel 118 can allow the thin film transistor included in each of the pixels to be activated (or turned-on) in response to the gate signal on the respective gate line. Then, the data voltage on the data line can be transferred to the pixel electrode through the activated (or turned-on) thin film transistor. As such, liquid crystal molecules of the liquid crystal layer are re-aligned by an electric field which is formed by a voltage difference between the data voltage on the pixel electrode and the common voltage on the common electrode, thereby controlling light transmittance of the liquid crystal layer. In accordance therewith, an image can be displayed on the liquid crystal display panel 118.

Such upper and lower substrates 115 and 116 of the liquid crystal display panel 118 can be formed from a glass material and a variety of layers can be formed on each of the upper and lower substrates 115 and 116. The liquid crystal display device 10 including the liquid crystal display panel 118 is disposed within a vehicle. However, a variety of strong shakes must be always generated in the vehicles. For example, the variety of shakes can include a shake caused by an engine, another shake caused by inflow air from the exterior of the vehicle, still another shake caused by a collision between the respective vehicle and an adjacent vehicle thereto, and further still shake caused by the body of the respective vehicle. As such, the liquid crystal display panel 118 of the liquid crystal display device 10 can be bumped against a guide member. Due to this, at least one of the upper and lower substrates 115 and 116 of the liquid crystal display panel 118 can be broken or cracked.

If at least one of the upper and low substrates 115 and 116 is broken or cracked, the signal lines for transferring a variety of signals, such as the gate lines, the data lines, the common voltage line and LOG (line-on-glass) signal lines, can be disconnected or snapped. The disconnected signal lines cannot transfer the signals. As such, the liquid crystal display panel 118 is abnormally driven or malfunctions. Due to this, the liquid crystal display panel 118 must display a distorted image or cannot display any image.

In view of this point, it is necessary to detect whether or not the signal lines are disconnected. To this end, at least one crack detection line 120 can be disposed alone the edge (or rim) of the liquid crystal display panel 118, that is, of at least one of the upper and lower substrates 115 and 116.

In this manner, when the signals or the voltages are normally input to or output from the above-mentioned components, such as the LVDS interface 106, the timing controller 108, the supply voltage generator 110, the backlight driver 112, the gate driver circuits, the data driver circuits 128 and so on, a desired image can be displayed on the liquid crystal display panel 118. On the contrary, if the signals or the voltages cannot be normally input to and output from some of the components, either a distorted image can be displayed or any image cannot be displayed due to the malfunction of the liquid crystal display panel 118.

The liquid crystal display device 10 according to an embodiment of the present disclosure enables whether or not signals generated in the input and output terminals of the above-mentioned components are abnormal to be detected. Also, the liquid crystal display device 10 allows detection signals representing whether or not the signals generated in the input and output terminals of the components (hereinafter, "abnormity detection signals ① through ⑧") to be transferred the diagnosis controller 114. As such, the diagnosis controller 114 can generally diagnose the components on the basis of the abnormity detection signals ① through ⑧ and generate a diagnosis resultant ⑨. Also, the diagnosis controller 114 can transfer the diagnosis resultant ⑨ to the system controller 40 shown in FIG. 2.

For example, the liquid crystal display device 10 of the present disclosure can generate first through third abnormity detection signals ① through ⑧. However, the liquid crystal display device 10 is not limited to this.

The first abnormity detection signal ① can be a signal which is attenuated by the bonding resistance between the first carrier package 122 and the data driver circuit 128, as an example.

The second abnormity detection signal ② can be a signal representing whether or not each of the data driver circuits 128 normally recoveries the EPI data signal applied from the timing controller 108, as an example.

The third abnormity detection signal ③ can be a signal representing whether or not a crack is generated in the liquid crystal display panel 118, as an example.

The fourth abnormity detection signal ④ can be a signal representing current consumption of the data driver circuit 128. In detail, the fourth abnormity detection signal ④ can have a current value corresponding to a data driving voltage which is transferred from the supply voltage generator 110 to the data driver circuit 128.

The fifth abnormity detection signal ⑤ can be a signal representing whether or not an error is generated in the LVDS interface 108.

The sixth abnormity detection signal ⑥ can be a signal representing whether or not an error is generated in the backlight driver 112.

The seventh abnormity detection signal ⑦ can be a signal representing whether or not an external main supply voltage is normally applied to the supply voltage generator 110 via the input connector 102.

The eighth abnormity detection signal ⑧ can be a signal representing whether or not a driving voltage used to drive the backlight driver 112 is normal. In other words, the eighth abnormity detection signal ⑧ can be a voltage which is transferred from the supply voltage generator 110 to the backlight driver 112.

The system controller 40 can perform measures opposite to the diagnosis resultant ⑨ which is transferred from the diagnosis controller 114. As an example of the opposite measure, the system controller 40 can supply one of different liquid crystal display devices (for example, the second and/or third liquid crystal display device(s)) with related information opposite to the diagnosis resultant ⑨. Alternatively, the system controller 40 can intercept (or turn-off) power of the first liquid crystal display device 10 or control the first liquid crystal display device to be initialized. However, the system controller 40 is not limited to these.

Subsequently, methods of detecting principal abnormity detection signals will be described with reference to FIGS. 4 through 6.

Figure 4:
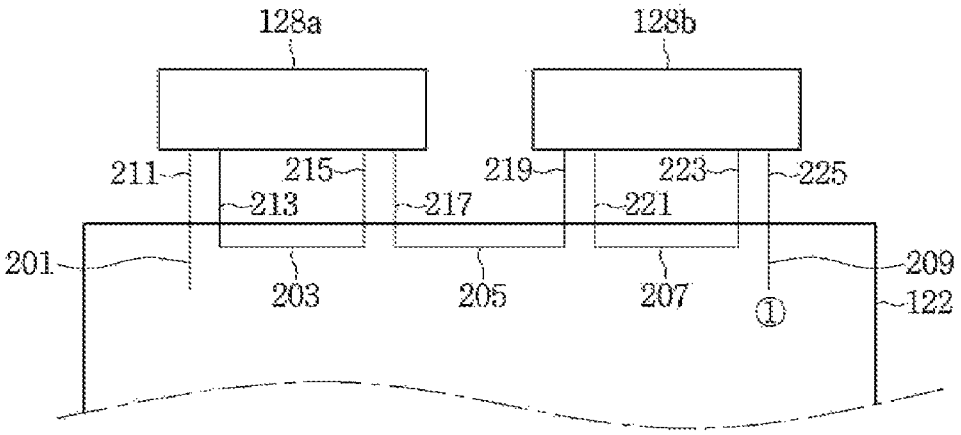
FIG. 4 shows a state that a first abnormity detection signal is detected in the liquid crystal display device of FIG. 3.
Figure 5:
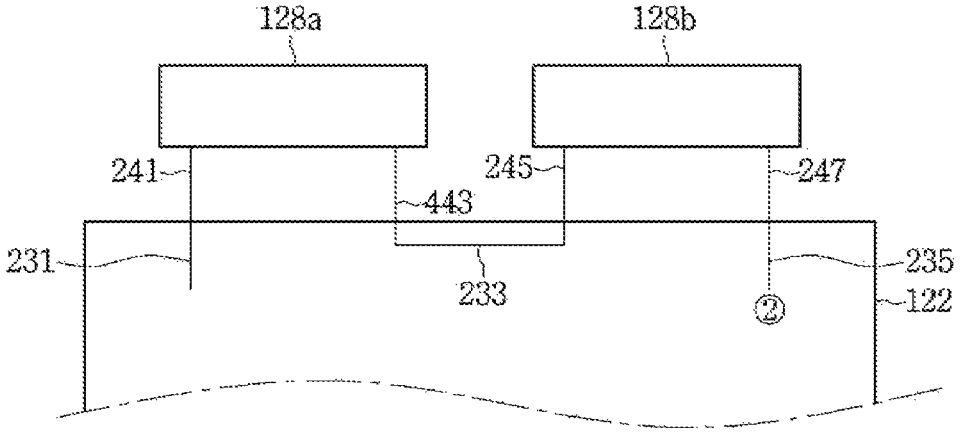
FIG. 5 shows a state that a second abnormity detection signal is detected in the liquid crystal display device of FIG. 3.
Figure 6:
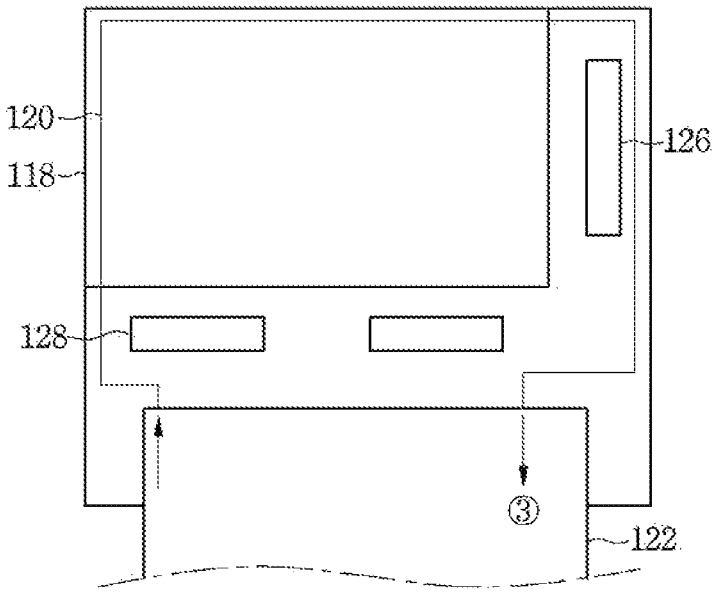
FIG. 6 shows a state that a third abnormity detection signal is detected in the liquid crystal display device of FIG. 3.

Components not shown in FIGS. 4 through 6 can be easily understood from those of FIG. 3. As such, the components not shown in FIGS. 4 through 6 will be referred to as the same name and numeral as those shown in FIG. 3.

FIG. 4 shows a state that a first abnormity detection signal is detected in the liquid crystal display device of FIG. 3.

Referring to FIG. 4, the data driver circuits 128*a* and 128*b* can be connected to the printed circuit board 100 via the first carrier package 122.

The data driver circuits 128*a* and 128*b* can be disposed on the liquid crystal display panel 118 (in detail, on the lower substrate 116) in a COG (chip-on-glass) mode. In other words, input and output pins of the data driver circuits 128*a* and 128*b* can be disposed on (or connected to) the lower substrate 116 of the liquid crystal display panel 118 through a bonding process.

As such, patterned signal lines 201, 203, 205, 207 and 209 formed on the first carrier package 122 can be connected to LOG signal lines 211, 213, 215, 217, 219, 221, 223 and 225 which are formed on the lower substrate 116 of the liquid crystal display panel 118 in an LOG (line-on-glass) mode. The input and output pins of the data driver circuits 128*a* and 128*b* can be connected to the respective LOG signal lines 211, 213, 215, 217, 219, 211, 213 and 215 through the bonding process.

A bonding resistance between the data driver circuit 128 and the first carrier package 122 depends on not only a degree of the bonding combination between the data driver circuits 128*a* and 128*b* and the lower substrate 116 of the liquid crystal display panel 118 but also a degree of the bonding combination between the first carrier package 122 and the lower substrate 116 of the liquid crystal display panel 118. For example, if the bonding combination between the data driver circuits 128*a* and 128*b* and the lower substrate 116 of the liquid crystal display panel 118 and/or the bonding combination between the first carrier package 122 and the lower substrate 116 of the liquid crystal display panel 118 are not superior, a bonding resistance between the data driver circuits 128*a* and 128*b* and the lower substrate 116 of the liquid crystal display panel 118 and/or another bonding resistance between the first carrier package 122 and the lower substrate 116 of the liquid crystal display panel 118 can be increased. In this case, signals being transferred to the data lines through the input and output pins of the data driver circuits 128*a* and 128*b* or different signals being applied from the first carrier package 122 to the lower substrate 116 of the liquid crystal display panel 118 are attenuated and delayed due to the increased bonding resistances. Due to this, image quality of the liquid crystal display panel 118 can deteriorate or the liquid crystal display panel 118 can malfunction.

The liquid crystal display device 10 according to an embodiment of the present disclosure can include first and second data driver circuits 128*a* and 128*b*, as an example. As such, in order to detect the bonding resistance, not only first through fifth patterned signal lines 201, 203, 205, 207 and 209 can be disposed on the first carrier package 122 but also first through eighth LOG signal lines 211, 213, 215, 217, 219, 211, 213 and 215 can be disposed on the lower substrate 116 of the liquid crystal display panel 118.

In this case, the first patterned signal line 201 of the first carrier package 122 can be connected to the first LOG signal line 211 of the lower substrate 116 using the bonding process. The first LOG signal line 211 can be connected to a first input pin of the first data driver circuit 128*a* through the bonding process. The first input pin of the first data driver circuit 128*a* can be connected to a first output pin of the first data driver circuit 128*a*. The first output pin of the first data driver circuit 128*a* can be connected to the second LOG signal line 213 of the lower substrate 116 through the bonding process. The second LOG signal line 213 of the lower substrate 116 can be connected to the second patterned signal line 203 of the first carrier package 122 through the bonding process. The second patterned signal line 203 of the first carrier package 122 can be connected to the third LOG signal line 215 of the lower substrate 116 through the bonding process. The third LOG signal line 215 of the lower substrate 116 can be connected to a second input pin of the first data driver circuit 128*a* through the bonding process. The second input pin of the first data driver circuit 128*a* can be connected to a second output pin of the first data driver circuit 128*a*. The second output pin of the first data driver circuit 128*a* can be connected to a fourth LOG signal line 217 of the lower substrate 116 through the bonding process. The fourth LOG signal line 217 of the lower substrate 116 can be connected to the third patterned signal line 205 of the first carrier package 122 through the bonding process.

Continuously, the third patterned signal line 205 of the first carrier package 122 can be connected to the fifth LOG signal line 219 of the lower substrate 116 through the bonding process. The fifth LOG signal line 219 of the lower substrate 116 can be connected to a first input pin of the second data driver circuit 128*b* through the bonding process. The first input pin of the second data driver circuit 128*b* can be connected to a first output pin of the second data driver circuit 128*b*. The first output pin of the second data driver circuit 128*b* can be connected to the sixth LOG signal line 221 of the lower substrate 116 through the bonding process. The sixth LOG signal line 221 of the lower substrate 116 can be connected to the fourth patterned signal line 207 of the first carrier package 122 through the bonding process. The fourth patterned signal line 207 of the first carrier package 122 can be connected to the seventh LOG signal line 223 of the lower substrate 116 through the bonding process. The seventh LOG signal line 223 of the lower substrate 116 can be connected to a second input pin of the second data driver circuit 128*b* through the bonding process. The second input pin of the second data driver circuit 128*b* can be connected to a second output pin of the second data driver circuit 128*b*. The second output pin of the second data driver circuit 128*b* can be connected to the eighth LOG signal line 225 of the lower substrate 116 through the bonding process. The eighth LOG signal line 225 can be connected to the fifth patterned signal line 209 of the first carrier package 122 through the bonding process.

In order to inspect the bonding resistance of such a diagnosis loop, a reference voltage is applied to the first patterned signal line 201 of the first carrier package 122. For example, the reference voltage can be about 3.3V. Such a reference voltage can be generated in one of the timing controller 108 and the supply voltage generator 110 and transferred to the first patterned signal line 201 of the first carrier package 122.

The reference voltage applied to the first patterned signal line 201 of the first carrier package 122 can sequentially pass through the first LOG signal line 211 of the lower substrate 116, the first input pin and the first output pin of the first data driver circuit 128*a*, the second LOG signal line 213 of the lower substrate 116, the second patterned signal line 203 of the first carrier package 122, the third LOG signal line 215 of the lower substrate 116, the second input pin and the second output pin of the first data driver circuit 128*a*, the fourth LOG signal line 217 of the lower substrate 116, the third patterned signal line 205, the fifth LOG line 219 of the lower substrate 116, the first input pin and the first output pin of the second data driver circuit 128*b*, the sixth LOG signal line 221 of the lower substrate 116, the fourth patterned signal line 207 of the first carrier package 122, the seventh LOG signal line 223 of the lower substrate 116, the second input pin and the second output pin of the second data driver circuit 128*b*, the eighth LOG signal line 225 of the lower substrate 116 and the fifth patterned signal line 209 of the first carrier package 122, and then be output as the first abnormity detection signal ①.

The first abnormity detection signal ① can be transferred to the diagnosis controller 114. As such, the diagnosis controller 114 can detect (or determine) a defective degree of the bonding combination on the basis of the first abnormity detection signal ① For example, although the reference voltage of 3.3V is applied to the first patterned signal line 201 of the first carrier package 122, the first abnormity detection signal ① of 2V can be output from the fifth patterned signal line 205 of the first carrier package 122. In this case, it can be detected that a voltage attenuation of 1.3V is generated by the bonding resistances between the first through fifth patterned signal lines 201, 203, 205, 207 and 209 of the first carrier package 122, the first through eighth signal lines 211, 213, 215, 217, 219, 221, 223 and 225 of the lower substrate 116 of the liquid crystal display panel 118, the first and second input pins and the first and second output pins of the first data driver circuit 128*a* and the first and second input pins and the first and second output pins of the second data driver circuit 128*b*.

In other words, the first abnormity detection signal ① output from the fifth patterned signal line 209 of the first carrier package 122 can become a lowered voltage which is attenuated (or dropped) from the reference voltage by the following bonding resistances. As such, a defective degree of the bonding combination between the first carrier package 122 and the lower substrate 116 of the liquid crystal display panel 118 and another defective degree of the bonding combination between the lower substrate 116 of the liquid crystal display panel 118 and the data driver circuits 128*a* and 128*b* can be detected from the first abnormity detection signal ①.

The bonding resistances reflected to the first abnormity detection signal ① can include a first bonding resistance between the first patterned signal line 201 and the first LOG signal line 211 of the lower substrate 116, a second bonding resistance between the first LOG signal line of the lower substrate 116 and the first input pin of the first data driver circuit 128*a*, a third bonding resistance between the first output pin of the first data driver circuit 128*a* and the second LOG signal line 213 of the lower substrate 116, and a fourth bonding resistance between the second LOG signal line 213 of the lower substrate 116 and the second patterned signal line 203 of the first carrier package 122. Also, the bonding resistances can include a fifth bonding resistance between the second patterned signal line 203 of the first carrier package 122 and the third LOG signal line 215 of the lower substrate 116, a sixth bonding resistance between the third LOG signal line 215 of the lower substrate 116 and the second input pin of the first data driver circuit 128*a*, a seventh bonding resistance between the second output pin of the first data driver circuit 128*a* and the fourth LOG signal line 217 of the lower substrate 116, and an eighth bonding resistance between the fourth LOG signal line 217 of the lower substrate 116 and the third patterned signal line 205 of the first carrier package 122. Moreover, the bonding resistances can include a ninth bonding resistance between the third patterned signal line 205 of the first carrier package 122 and the fifth LOG signal line 219 of the lower substrate 116, a tenth bonding resistance between the fifth LOG signal line 219 of the lower substrate 116 and the first input pin of the second data driver circuit 128*b*, a eleventh bonding resistance between the first output pin of the second data driver circuit 128*b* and the sixth LOG signal line 221 of the lower substrate 116, and a twelfth bonding resistance between the sixth LOG signal line 221 of the lower substrate 116 and the fourth patterned signal line 207 of the first carrier package 122. Furthermore, the bonding resistances can include a thirteenth bonding resistance between the fourth patterned signal line 207 of the first carrier package 122 and the seventh LOG signal line 223 of the lower substrate 116, a fourteenth bonding resistance between the seventh LOG signal line 223 of the lower substrate 116 and the second input pin of the second data driver circuit 128*b*, a fifteenth bonding resistance between the second output pin of the second data driver circuit 128*b* and the eighth LOG signal line 225 of the lower substrate 116, and a sixteenth bonding resistance between the eighth LOG signal line 225 of the lower substrate 116 and the fifth patterned signal line 209 of the first carrier package 128*b*.

With the exception of the first and second data driver circuits 128*a* and 128*b*, at least one additional data driver circuit can be included in the liquid crystal display panel 118. In this case, the data driver circuits can be connected in the above-mentioned connection relationship.

FIG. 5 shows a state that a second abnormity detection signal is detected in the liquid crystal display device of FIG. 3.

Referring to FIG. 5, a lock signal together with the EPI data signals can be transferred from the timing controller 108 to the data driver circuits 128*a* and 128*b*. The EPI data signals can be applied to the data driver circuits 128*a* and 128*b*, respectively. The lock signal can be applied to the first data driver circuit 128*a*, sequentially transferred from the first data driver circuit 128*a* to a final data driver circuit 128*b* via different data driver circuits between them, and fed-back from the final data driver circuit 128*b*. A feedback signal output from the final data driver circuit 128*b* can be provided as the second abnormity detection signal ②. The second abnormity detection signal ② can be transferred from the final data driver circuit 128*b* to one the timing controller 108 and the diagnosis controller 114.

On the basis of the second abnormity detection signal ②, it can be detected whether or not the data driver circuits 128*a* and 128*b* are abnormal. For example, the lock signal with a high level can be transferred from the timing controller 108 to the first data driver circuit 128*a*. In this case, if the second abnormity detection signal ② of the high level is output from the final data driver circuit 128*b*, it can be determined (or detected) that the data driver circuits 128*a* and 128*b* are normal. On the contrary, when the abnormity detection signal ② with a low level is output from the final data driver circuit 128*b*, it can be detected that at least one of the data driver circuits 128*a* and 128*b* is abnormal. As such, the diagnosis controller 114 can determine (or detect) whether or not the data driver circuit 128*a* and 128*b* are normal on the basis of the second abnormity detection signal ②.

In order to input the lock signal and output the second abnormity detection signal ②, the first carrier package 122, the lower substrate 116 of the liquid crystal display panel 118 and the data driver circuits 128*a* and 128*b* can be connected to one another in the following connection relationship.

First through third patterned signal lines 231, 233 and 235 can be formed on the first carrier package 122 and first through fourth LOG signal lines 241, 243, 245 and 247 can be formed on the lower substrate 116 of the liquid crystal display panel 118, in order to input the lock signal and output the second abnormity detection signal ②.

The first through third patterned signal lines 231, 233 and 235 formed on the first carrier package 122 and the first through fourth LOG signal lines 241, 243, 245 and 247 formed on the lower substrate 116 can be provided separately from the first through fifth patterned signal lines 201, 203, 205, 207 and 209 and the first through eighth LOG signal lines 211, 213, 215, 217, 219, 221, 223 and 225 which are formed on the first carrier package 122 and the lower substrate 116 and used to obtain the first abnormity detection signal ① representing whether or not an abnormity is generated by the bonding resistance in FIG. 4.

Such a first patterned signal line 231 of the first carrier package 122 can be connected to the first LOG signal line 241 of the lower substrate 116 of the liquid crystal display panel 118 through the bonding process. The first LOG signal line 241 of the lower substrate 116 can be connected to an input pin of the first data driver circuit 128*a* through the bonding process. The input pin of the first data driver circuit 128*a* is connected to an output pin of the first data driver circuit 128*a* via an internal circuit of the first data driver circuit 128*a*. The output pin of the first data driver circuit 128*a* can be connected to the second LOG signal line 243 of the lower substrate 116 through the bonding process. The second patterned signal line 233 of the first carrier package 122 can be connected to the third LOG signal line 245 of the lower substrate 116 through the bonding process. The third LOG signal line 245 of the lower substrate 116 can be connected to an input pin of the second data driver circuit 128*b* through the bonding process. The input pin of the second data driver circuit 128*b* is connected to an output pin of the second data driver circuit 128*b* via an internal circuit of the second data driver circuit 128*b*. The output pin of the second data driver circuit 128*b* can be connected to the fourth LOG signal line 247 of the lower substrate 116 through the bonding process. The fourth LOG signal line 247 of the lower substrate 116 can be connected to the third patterned signal line 235 of the first carrier package 122 through the bonding process.

The lock signal can be transferred from the timing controller 108 to the first patterned signal line 231 of the first carrier package 122. The lock signal applied to the first patterned signal line 231 of the first carrier package 122 can be output (or fed-back) from the third patterned signal line 235 of the first carrier package 122 via the first LOG signal line 241 of the lower substrate 116, the input pin, internal circuit and output pin of the first data driver circuit 128*a*, the second LOG signal line 243 of the lower substrate 116, the second patterned signal line 233 of the first carrier package 122, the third LOG signal line 245 of the lower substrate 116, the input pin, internal circuit and output pin of the second data driver circuit 128*b* and the fourth LOG signal line 247 of the lower substrate 116.

The lock signal can be level-shifted when it passes through at least one of the first and second data driver circuits 128*a* and 128*b*.

For example, the first data driver circuit 128*a* can be abnormal but the second data driver circuit 128*b* can be normal. In this case, the lock signal can be transitioned from the high level to the low level in the first data driver circuit 128*a* with an abnormity. As such, the lock signal with the low level can be transferred from the first data driver circuit 128*a* to the second data driver circuit 129*b* and pass through the second data driver circuit 128*b* without any level variation. Consequently, the lock signal can be output from the second data driver circuit 128*b* as the second abnormity detection signal ②. In accordance therewith, the diagnosis controller 114 can detect (or determine) that at least one of the first and second data driver circuits 128*a* and 128*b* is abnormal, on the basis of the second abnormity detection signal ② of the low level.

As another example, the first data driver circuit 128*a* is normal but the second driver circuit 128*b* is abnormal. In this case, the lock signal can pass through the first data driver circuit 128*a* without any level variation. As such, the lock signal can be transferred from the timing controller 108 to the second data driver circuit 128*b* via the first data driver circuit 128*a* as it is. However, the lock signal can be transitioned from the high level into the low level in the second data driver circuit 128*b* with an abnormity. Therefore, the lock signal with the low level can be output from the second data driver circuit as the second abnormity detection signal ②.

FIG. 6 shows a state that a third abnormity detection signal is detected in the liquid crystal display device of FIG. 3.

Referring to FIG. 6, a crack detection line 120 can be disposed along edges of the liquid crystal display panel 118. The crack detection line 120 can be disposed on one or both (or at least one) of the upper substrate 115 and the lower substrate 116.

If the crack detection line 120 is disposed on the lower substrate 116, the crack detection line 120 can be simultaneously formed when one of the gate line, the data line and the pixel electrode is formed. As such, the crack detection line 120 does not require any addition process. Also, the crack detection line 120 can be formed from the same material as one of the gate line, the data line and the pixel electrode, but it is not limited to this.

Alternatively, when the crack detection line 120 is disposed on the upper substrate 115, the crack detection line 120 can be simultaneously formed at the formation of the common electrode without any additional process. As such, the crack detection line 120 can be formed from the same material as the common electrode, but it is not limited to this.

One end of the crack detection line 120 can be connected to a first patterned signal line which is formed on the first carrier package 122. The other one of the crack detection line 120 can be connected to a second patterned signal line which is formed on the first carrier package 122. The first and second patterned signal lines formed on the first carrier package 122 can be separately provided from the first through fifth patterned signal lines (shown in FIG. 4) which are formed on the first carrier package 122 and used to detect the bonding resistance, and the first through third patterned signal lines (shown in FIG. 5) which are formed on the first carrier package 122 and used to check the lock signal.

As described above, the upper and lower substrates 115 and 116 of the liquid crystal display panel 118 are each formed from a glass material and loaded with a variety of layers. As such, the upper substrate 115 and/or the lower substrate 116 included in the liquid crystal display panel 118 can be easily broken or cracked due to the shakes of the vehicle. If at least one of the upper and low substrates 115 and 116 of the liquid crystal display panel 118 is broken or cracked, the signal lines for transferring a variety of signals, such as the gate lines, the data lines, the common voltage line and LOG (line-on-glass) signal lines, for transferring a variety of signals can be disconnected or snapped. The disconnected signal lines cannot transfer the signals. As such, the liquid crystal display panel 118 is abnormally driven or malfunctions. Due to this, the liquid crystal display panel 118 must display a distorted image or cannot display any image.

To address this matter, the liquid crystal display device 10 of the present disclosure can include the crack detection line 120 which is used to detect whether or not the signal lines are disconnected or snapped.

In order to detect the disconnection of the signal lines, a reference voltage can be generated in one of the timing controller 108 and the supply voltage generator 110 and transferred to the first patterned signal line of the first carrier package 122. The reference voltage can be output from the second pattern signal line of the first carrier package 122 via the crack detection line 120, which is disposed on the liquid crystal display panel 118, as a third abnormity detection signal ③. The third abnormity detection signal ③ can be transferred to the diagnosis controller 114. Then, the diagnosis controller 114 can detect whether or not a crack is generated in the liquid crystal display panel 118, on the third abnormity detection signal ③.

For example, the signal lines and the crack detection line 120 are disconnected or snapped by a crack which is generated in the liquid crystal display panel 118. In this case, any signal is not output from the second patterned signal line of the first carrier package 122. In other words, the third abnormity detection signal ③ of a floating state is developed on the second patterned signal line of the first carrier package 122.

As another example, the liquid crystal display panel 118 is not cracked and the crack detection line 120 is not disconnected. As such, the third abnormity detection signal ③ with the same level as or a similar level to the reference voltage applied to the first patterned signal line of the first carrier package 122 can be output from the second patterned signal line of the first carrier package 122.

To return FIG. 3, the fourth abnormity detection signal ④ represents a state of a data driving voltage which is transferred from the supply voltage generator 110 to the data driver circuits 128. The fourth abnormity detection signal ④ can be obtained by detecting the data driving voltage and converting the detected data driving voltage. In other words, a current consumption quantity of the data driver circuits 128 can be detected by the fourth abnormity detection signal ④. Such a fourth abnormity detection signal ④ can be transferred to the diagnosis controller 114.

The fifth abnormity detection signal ⑤ can be generated in an error detector built-in the LVDS interface 106 as shown in FIG. 3. The error detector of the LVDS interface 105 can detect whether or not an error is generated in the signals applied from the system controller 40. The fifth abnormity detection signal ⑤ reflecting whether or not an error can be transferred from the error generator of the LVDS interface 105 to the diagnosis controller 114.

The sixth abnormity detection signal ⑥ can be generated in an error detector built-in the backlight driver 112, as shown in FIG. 3. The backlight driver 112 can derive the backlight driving voltage, which is necessary to drive the backlight unit 130, from the supply voltage applied from the supply voltage generator 110. The error detector of the backlight driver 112 can generates the sixth abnormity detection signal ⑥ representing whether or not an error is generated in a process of deriving the data driving voltage from the supply voltage. The sixth abnormity detection signal ⑥ can be transferred from the error detector of the backlight driver 112 to the diagnosis controller 114.

The seventh abnormity detection signal ⑦ can be derived from the external main supply voltage which is transferred to the supply voltage generator 110 through the input connector 102, as shown in FIG. 3. The main supply voltage can be abnormally input from the exterior or varied by the input connector 102. As such, whether or not the main supply voltage transferred from the input connector 102 to the supply voltage generator 110 is normal can be detected by the seventh abnormity detection signal ⑦. The seventh abnormity detection signal ⑦ can be transferred to the diagnosis controller 114.

The eighth abnormity detection signal ⑧ can be derived from a supply voltage which is used to drive the backlight driver 112. The supply voltage used to generate the backlight driving voltage can be transferred from the supply voltage generator 110 to the backlight driver 113. If an abnormity is generated in the signal line between the supply voltage generator 110 and the backlight driver 112, the supply voltage generated in the supply voltage generator 110 cannot be normally transferred to the backlight driver 112. As such, whether or not the supply voltage transferred from the supply voltage generator 110 to the backlight driver 112 is normal can be detected by the eighth abnormity detection signal ⑧. The eighth abnormity detection signal ⑧ can be transferred to the diagnosis controller 114.

Although they are not shown in the drawings, the other abnormity detection signals representing whether or not the timing controller 108 and the gate driver circuit 126 are normal can also be transferred to the diagnosis controller 114 and used to generate the diagnosed resultant of the diagnosis controller 114.

Figure 7:
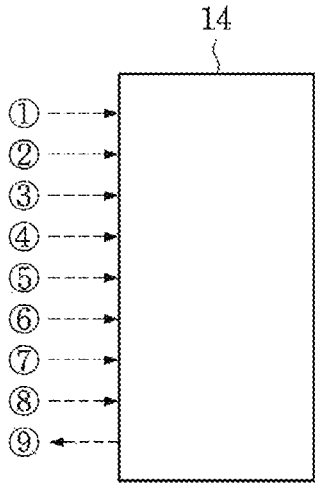
FIG. 7 is a circuit diagram showing an example of the diagnosis controller included in the liquid crystal display device of FIG. 3.

FIG. 7 is a circuit diagram showing an example of the diagnosis controller included in the liquid crystal display device of FIG. 3.

Referring to FIG. 7, the diagnosis controller 114 according an example can input first through eighth abnormity detection signals ① through ⑧. Also, the diagnosis controller 114 can generally diagnose the respective liquid crystal display device 10 by closely checking the first through eighth abnormity detection signals ① through ⑧. Moreover, the diagnosis controller 114 can transfer the diagnosed resultant ⑨ to the system controller 40 (shown in FIG. 2).

Such a diagnosis controller 114 can include first through eighth input pins and a single output pin. The first through eighth input pins are used to receive the first through eighth abnormity detection signals ① through ⑧. The output pin is used to transfer the diagnosed resultant ⑨.

The first, fourth, seventh and eighth abnormity detection signals ①, ④, ⑦ and ⑧ are analog signals. In order to process the first, fourth, seventh and eighth abnormity detection signals ①, ④, ⑦ and ⑧, the diagnosis controller 114 includes analog-to-digital converter (not shown) configured to convert an analog signal into a digital signal. The analog-to-digital converter can be connected to the first, fourth, seventh and eighth input pins which are used to receive the first, fourth, seventh and eighth abnormity detection signals ①, ④, ⑦ and ⑧.

On the other hand, the second, fifth and sixth abnormity detection signals ②, ⑤ and ⑥ are digital signals. As such, the second, fifth and sixth abnormity detection signals ②, ⑤ and ⑥ do not require the analog-to-digital converter.

Meanwhile, the third abnormity detection signal ③ can be generated in a floating state in which any signal information is not represented. As such, the diagnosis controller 114 can further include an additional circuit, such as a voltage divider shown in FIG. 8. The additional circuit can converts the third abnormity detection signal ③ into a digital signal (or a logic signal). To this end, the additional circuit can be built in the diagnosis controller 114 in such a manner as to be connected to the third input pin. This additional circuit will be described later.

The diagnosed resultant ⑨ can be defined into the table 1 as described above. The diagnosed resultant ⑨ of a first level Lv1 represents "normal". The diagnosed resultant ⑨ of a second level Lv2 represents "need of inspection". The diagnosed resultant ⑨ of a third level Lv3 represents "need of exchange".

Such a diagnosed resultant can be transferred from the diagnosis controller 114 to the system controller 40 using one of a PWM (pulse width modulation) method and an I2C communication method. However, the present disclosure is not limited to this. The PWM modulation can be performed by adjusting a duty ratio.

Figure 8:
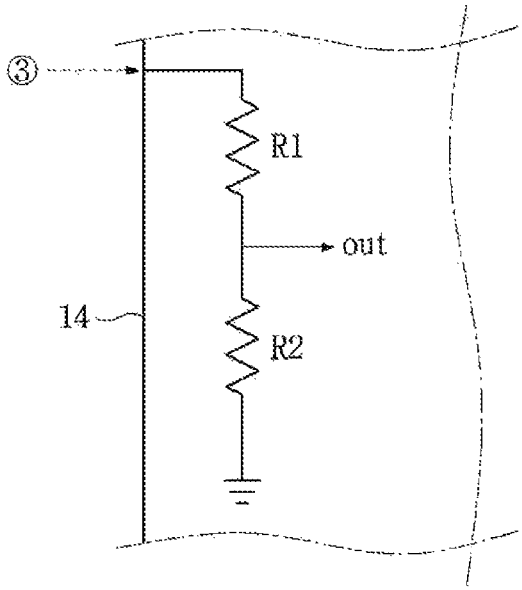
FIG. 8 is a circuit diagram showing a state that a third abnormity detection signal is input to the diagnosis controller in FIG. 3.

FIG. 8 is a circuit diagram showing a state that a third abnormity detection signal is input to the diagnosis controller in FIG. 3.

As shown in FIG. 8, the third abnormity detection signal ③ can be input to an additional circuit built in the diagnosis controller 114. The additional circuit built-in the diagnosis controller 114 can include first and second resistors R1 and R2 serially disposed between a ground line and the third input pin of the diagnosis controller 114 receiving the third abnormity detection signal ③. As such, the third abnormity detection signal ③ can be output through a node between the first and second resistors R1 and R2.

The third abnormity detection signal ③ represents whether or not a crack is generated in the liquid crystal display panel 118.

For example, the crack detection line 120 are disconnected or snapped by a crack which is generated in the liquid crystal display panel 118. In this case, the third abnormity detection signal ③ with a floating state (i.e., a high impedance state) is generated. In other words, any signal is not input to the third input pin of the diagnosis controller 114. As such, any voltage cannot be output through the node between the first and second resistors R1 and R2. However, the diagnosis controller 114 can obtain the third abnormity detection signal ③ with the low level because the second resistor R1 is connected to the ground line.

As another example, the liquid crystal display panel 118 is not cracked and the crack detection line 120 is not disconnected. In this case, the third abnormity detection signal ③ with a fixed voltage (i.e., the reference voltage) can be generated and transferred to the third input pin of the diagnosis controller 114. Also, the third abnormity detection signal ③ is voltage-divided by the first and second resistors R1 and R2 and output through the node between the first and second resistors R1 and R2. As such, the diagnosis controller 114 can obtain the third abnormity detection signal ③ with the high level.

Figure 9:
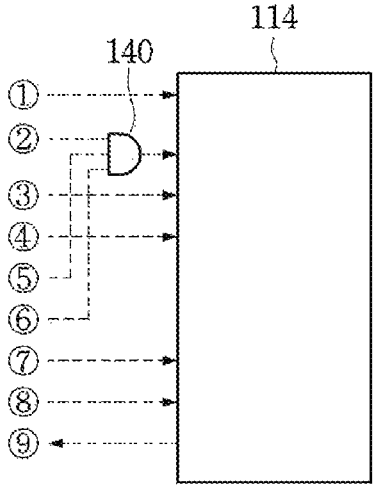
FIG. 9 is a circuit diagram showing another example of the diagnosis controller included in the liquid crystal display device of FIG. 3.

FIG. 9 is a circuit diagram showing another example of the diagnosis controller included in the liquid crystal display device of FIG. 3.

Referring to FIG. 9, the diagnosis controller 114 can be connected a logic gate 140. The logic gate 140 can be an AND gate.

The first through eighth abnormity detection signals ① through ⑧ can be input to the diagnosis controller 114, but some of the first through eighth abnormity detection signals ① through ⑧, such as the second, fifth and sixth abnormity detection signals ②, ⑤ and ⑥, can be input to first through third input electrodes of the AND gate 140 without being directly input the diagnosis controller 114.

The AND gate 140 can logically AND-operate the second, third and sixth abnormity detection signals ②, ⑤ and ⑥ and output an AND-operated output signal to the diagnosis controller 114. For example, if all the second, fifth and sixth abnormity detection signals ②, ⑤ and ⑥ have the high level, the AND gate 140 can output an composite abnormity detection signal with the high level. As another example, when at least one of the second, fifth and sixth abnormity detection signals ②, ⑤ and ⑥ has the low level, the AND gate 140 can output the composite abnormity detection signal with the low level. The composite abnormity detection signal with the low level can represent that at least one of the second, fifth and sixth abnormity detection signals ②, ⑤ and ⑥ is abnormal.

In this manner, the three abnormity detection signals, i.e. the second, fifth and sixth abnormity detection signals ②, ⑤ and ⑥, can be pre-processed by the AND gate 140 and transferred to the diagnosis controller 114 as a single composite abnormity detection signal. As such, the input pins of the diagnosis controller 114 can be reduced in number.

In detail, the first example of the diagnosis controller 114 (shown in FIG. 7) requires eight input pins in order to input the first through eighth abnormity detection signals ① through ⑧. On the other hand, the second example of the diagnosis controller 114 uses only five input pins in order to input the first through eighth abnormity detection signals ① through ⑧. As such, the number of input pins of the diagnosis controller 114 can be decreased and furthermore the size of an IC chip corresponding to the diagnosis controller 114 can be reduced.

Consequently, the diagnosis controller 114 can directly input the first, third, fourth, seventh and eighth abnormity detection signals ①, ③, ④, ⑦ and ⑧ and receive the single composite abnormity detection signal which is obtained by AND-operating the second, fifth and sixth abnormity detection signals ②, ⑤ and ⑥ using the AND gate 140. Also, the diagnosis controller 114 can generally diagnose the respective liquid crystal display device 10 on the basis of the first, third, fourth, seventh and eighth abnormity detection signals ①, ③, ④, ⑦ and ⑧ and the composite abnormity detection signal. Moreover, the diagnosis controller 114 can generate the diagnosed resultant ⑨ and transfer the diagnosed resultant ⑨ to the system controller 40.

Although the present disclosure has been limitedly explained regarding only the embodiments described above, it should be considered as examples without being limitedly interpreted to the embodiments. As such, the scope of the present disclosure shall be determined only by reasonably interpreting the appended claims and include various changes or modifications of the appended claims within the equivalent scope of the present disclosure.

What is claimed is:

1. A liquid crystal display device comprising:

an LVDS (low voltage differential signal) interface configured to input external signals;

a timing controller configured to derive timing control signals from the signals applied from the LVDS interface;

at least one data driver circuit configured to apply data voltages to a liquid crystal display panel in response to the timing control signals;

a backlight driver configured to generate a backlight driving voltage to drive a backlight unit;

a supply voltage generator configured to generate supply voltages used to drive the LVDS interface, the timing controller and the data driver circuit; and a diagnosis controller configured to input abnormity detection signals representing whether the LVDS interface, the timing controller, the data driver circuit, the backlight driver and the supply voltage generator are abnormal and generate a diagnosed resultant, wherein the input abnormity detection signals input to the diagnosis controller includes an abnormity detection signal representing whether or not an error is generated in the LVDS interface, an abnormity detection signal representing whether or not an error is generated in the backlight driver, an abnormity detection signal representing whether or not an external main supply voltage is normally applied to the supply voltage generator, and an abnormity detection signal representing whether or not a driving voltage transferred from the supply voltage generator to the backlight driver is normal.

2. The liquid crystal display device of claim 1, further comprising a crack detection line along an edge of the liquid crystal display panel, wherein the input abnormity detection signals input to the diagnosis controller further includes an abnormity detection signal representing whether the crack detection line is disconnected.

3. The liquid crystal display device of claim 1, wherein the data driver circuit is on the liquid crystal display panel, and the abnormity detection signals input to the diagnosis controller further includes an abnormity detection signal reflecting a voltage attenuation caused by a bonding resistance between the data driver circuit and the liquid crystal display panel.

4. The liquid crystal display device of claim 1, wherein the abnormity detection signals input to the diagnosis controller further includes an abnormity detection signal which is based on a level variation of a lock signal being applied from the timing controller and passing through the data driver circuit and represents whether or not the data driver circuit is normal.

5. The liquid crystal display device of claim 1, further comprising a logic gate configured to logic-operate at least some of the input abnormity detection signals which output from each of the LVDS interface, the data driver circuit and the backlight driver and apply a logic-operated composite abnormity detection signal to the diagnosis controller.

6. The liquid crystal display device of claim 5, wherein the logic gate includes an AND gate.

7. The liquid crystal display device of claim 1, wherein the diagnosis controller externally transfers the diagnosed resultant using one of a PWM (pulse width modulation) method and an I2C communication method.

8. A display system, comprising:

a plurality of liquid crystal display devices disposed in a vehicle and configured to each generate a diagnosed resultant; and a system controller configured to perform measures opposite to the diagnosed resultants which are transferred from the liquid crystal display devices, wherein each of the liquid crystal display devices includes:

an LVDS (low voltage differential signal) interface configured to input external signals;

a timing controller configured to derive timing control signals from the signals applied from the LVDS interface;

at least one data driver circuit configured to apply data voltages to a liquid crystal display panel in response to the timing control signals;

a backlight driver configured to generate a backlight driving voltage used to drive a backlight unit;

a supply voltage generator configured to generate supply voltages used to drive the LVDS interface, the timing controller and the data driver circuit; and a diagnosis controller configured to input abnormity detection signals representing whether the LVDS interface, the timing controller, the data driver circuit, the backlight driver and the supply voltage generator are abnormal, to generate a diagnosed resultant, and to transfer the diagnosed resultant to the system controller, and wherein the input abnormity detection signals input to the diagnosis controller includes an abnormity detection signal representing whether or not an error is generated in the LVDS interface, an abnormity detection signal representing whether or not an error is generated in the backlight driver, an abnormity detection signal representing whether or not an external main supply voltage is normally applied to the supply voltage generator, and an abnormity detection signal representing whether or not a driving voltage transferred from the supply voltage generator to the backlight driver is normal.

9. The display system of claim 8, wherein the diagnosed resultants are transferred to the system controller using one of a PWM (pulse width modulation) method and an I2C communication method.

10. The display system of claim 8, wherein each of the liquid crystal display devices further includes a crack detection line disposed along an edge of the liquid crystal display panel, and the input abnormity detection signals input to the diagnosis controller further includes an abnormity detection signal representing whether the crack detection line is disconnected.

11. The display system device of claim 8, wherein the data driver circuit is disposed on the liquid crystal display panel, and the abnormity detection signals input to the diagnosis controller further includes an abnormity detection signal reflecting a voltage attenuation which is caused by a bonding resistance between the data driver circuit and the liquid crystal display panel.

12. The display system of claim 8, wherein the abnormity detection signals input to the diagnosis controller further includes an abnormity detection signal which is based on a level variation of a lock signal being applied from the timing controller and passing through the data driver circuit and represents whether or not the data driver circuit is normal.

13. The display system of claim 8, wherein each of the liquid crystal display devices further includes a logic gate configured to logic-operate at least some of the input abnormity detection signals which output from each of the LVDS interface, the data driver circuit and the backlight driver and apply a logic-operated composite abnormity detection signal to the diagnosis controller.

14. The display system of claim 13, wherein the logic gate includes an AND gate.

* * * * *